US007784909B2

(12) United States Patent
Anderson et al.

(10) Patent No.: US 7,784,909 B2
(45) Date of Patent: Aug. 31, 2010

(54) INK JETTING STRUCTURE HAVING PROTECTED CONNECTIONS

(75) Inventors: Frank Edward Anderson, Sadieville, KY (US); Michael John Dixon, Richmond, KY (US); Bryan Dale McKinley, Lexington, KY (US); Jeanne Marie Saldanha Singh, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 415 days.

(21) Appl. No.: 12/021,375

(22) Filed: Jan. 29, 2008

(65) Prior Publication Data

US 2009/0189954 A1 Jul. 30, 2009

(51) Int. Cl.
*B41J 2/14* (2006.01)

(52) U.S. Cl. ..... 347/50

(58) Field of Classification Search ..... 347/50, 347/57–58, 61–62, 84–86, 148
See application file for complete search history.

(56) References Cited

U.S. PATENT DOCUMENTS 7,370,943 B2 * 5/2008 Imai et al. ..... 347/58
7,597,422 B2 * 10/2009 Katayama et al. ..... 347/50
7,673,970 B2 * 3/2010 Bertelsen et al. ..... 347/50

* cited by examiner

*Primary Examiner*—Lamson D Nguyen

(57) ABSTRACT

An ink jetting structure includes a substrate that has a first surface and a second surface. A heater chip is mounted to the second surface of the substrate, and includes a first set of electrical contacts. A printhead circuit member has a third surface, a fourth surface, and an opening configured to receive the heater chip with the first set of electrical contacts of the heater chip being exposed through the opening. The third surface is mounted to the second surface of the substrate. The fourth surface has a second set of electrical contacts attached by wire bonds to the first set of electrical contacts. The third surface has a third set of electrical contacts electrically coupled to the second set of electrical contacts, and electrically connected to a flexible cable for coupling to corresponding contacts on a printer.

20 Claims, 4 Drawing Sheets

INK JETTING STRUCTURE HAVING PROTECTED CONNECTIONS

BACKGROUND OF THE INVENTION

1. Field of the Invention

The present invention relates to an ink jetting structure, and, more particularly, to an ink jetting structure having protected connections.

2. Description of the Related Art

In jet printheads includes electrical wiring traces and connection points for supplying electrical current to the printhead components, e.g., heater circuits. Corrosion occurs when moisture and ions in fluids attack the wiring traces or connection points, such as wire bonds, solder connections, and tape automated bonding (TAB) circuit bonds over time. Ionic species and moisture present in ink or left over from manufacturing processes migrate through or under various polymeric coatings (e.g., encapsulants, cover coats, solder masks) to reach the wiring traces and bonds where they chemically attack the metal leading to open circuits. Corrosion is accelerated by temperature and voltage. The electrical wiring traces and connection points most susceptible to ink attack are those on the exposed surface of the printhead, which also may be subjected to mechanical forces, such as contact with a printhead wiper blade.

SUMMARY OF THE INVENTION

The terms "first", "second", etc., preceding an element name, e.g., first end, second end, etc., are used for identification purposes to distinguish between similar or related elements, results or concepts, and are not intended to necessarily imply order, nor are the terms "first", "second", etc., intended to preclude the inclusion of additional similar or related elements, results or concepts, unless otherwise indicated.

The invention, in one form thereof, is directed to an ink jetting structure. A flexible cable has a plurality of conductors. The plurality of conductors has a first end and a second end, with the first end being for coupling to corresponding contacts on a printer. A substrate has a first surface and a second surface spaced from the first surface. The substrate has a second fluid passage extending from the first surface to the second surface. The second fluid passage is in fluid communication with the first fluid passage. An ink jet heater chip is mounted to the second surface of the substrate. The ink jet heater chip is in fluid communication with the second fluid passage of the substrate. The ink jet heater chip includes a first set of electrical contacts. A printhead circuit member has a third surface and a fourth surface spaced from the third surface with embedded conductors being located between the third surface and the fourth surface. The printhead circuit member has an opening configured to receive the ink jet heater chip with the first set of electrical contacts of the ink jet heater chip being exposed through the opening. The third surface is mounted to the second surface of the substrate. The fourth surface has a second set of electrical contacts attached by wire bonds to the first set of electrical contacts of the ink jet heater chip. The third surface has a third set of electrical contacts electrically coupled by the embedded conductors in the printhead circuit member to the second set of electrical contacts. The third set of electrical contacts is electrically connected to the second end of the plurality of conductors of the flexible cable.

The invention, in another form thereof, is directed to an ink jetting structure. The ink jetting structure includes a base having a floor and a plurality of side walls extending outwardly from the floor. The floor has a first fluid passage. A flexible cable has a plurality of conductors. The plurality of conductors has a first end and a second end, the first end being for coupling to corresponding contacts on a printer. A ceramic substrate has a first surface and a second surface spaced from the first surface. The first surface is mounted to the floor of the base. The ceramic substrate has a second plurality of fluid passages extending from the first surface to the second surface. The second plurality of fluid passages is in fluid communication with the first plurality of fluid passages. A plurality of ink jet heater chips is mounted to the second surface of the ceramic substrate. The plurality of ink jet heater chips is in fluid communication with the second plurality of fluid passages of the ceramic substrate, and each of the plurality of ink jet heater chips include a corresponding first set of electrical contacts. A printhead circuit member has a third surface and a fourth surface spaced from the third surface with embedded conductors being located between the third surface and the fourth surface. The printhead circuit member has a plurality of openings configured to receive the plurality of ink jet heater chips with the first set of electrical contacts of the plurality of ink jet heater chips being exposed through the plurality of openings. The third surface is mounted to the second surface of the ceramic substrate. The fourth surface has a second set of electrical contacts attached by wire bonds to the first set of electrical contacts of the plurality of ink jet heater chips. The third surface has a third set of electrical contacts electrically coupled by the embedded conductors in the printhead circuit member to the second set of electrical contacts, and the third set of electrical contacts are electrically connected to the second end of the plurality of conductors of the flexible cable.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
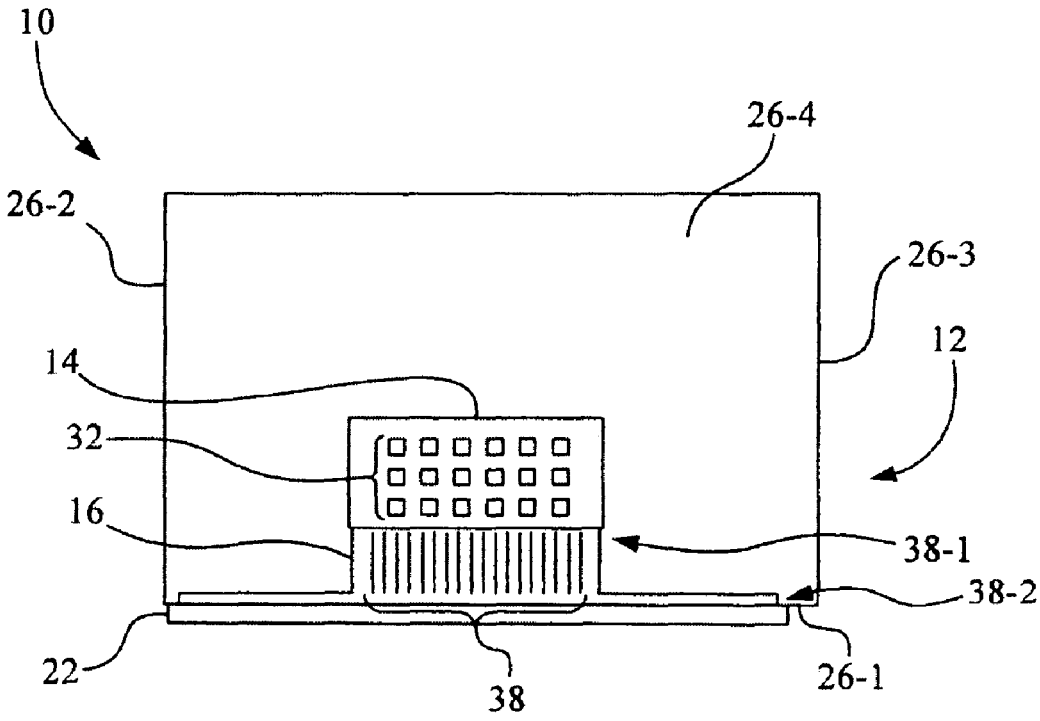
FIG. 1 is side view of an ink jetting structure configured in accordance with an embodiment of the present invention.
Figure 2:
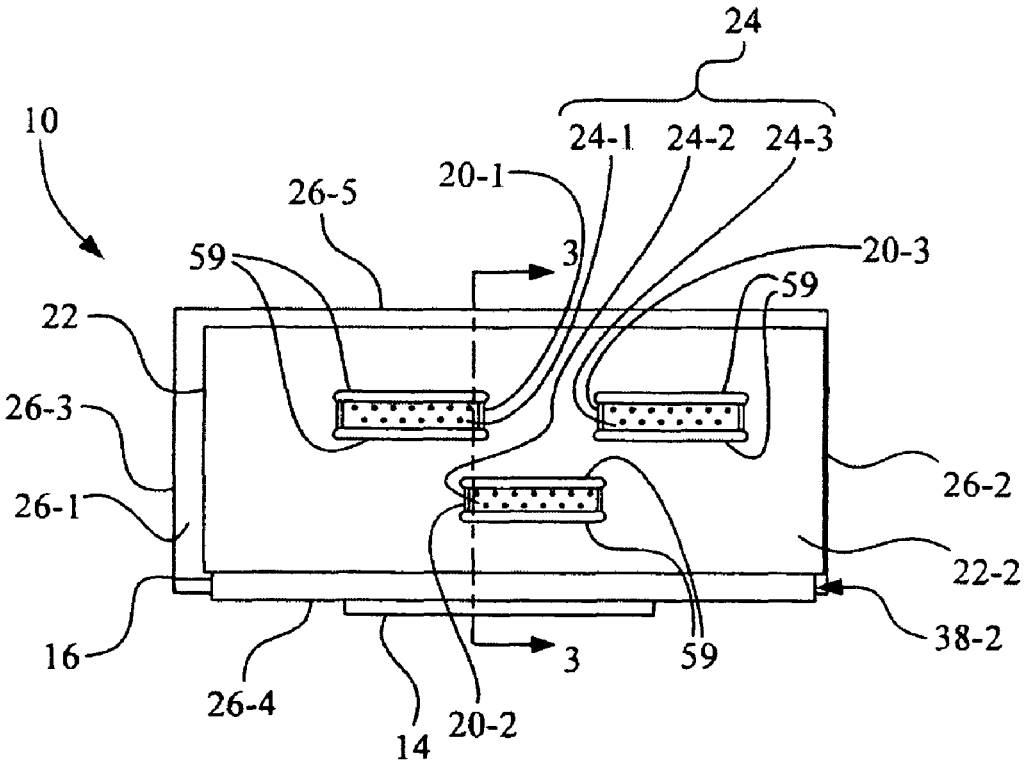
FIG. 2 is a bottom view of the ink jetting structure of FIG. 1.
Figure 3:
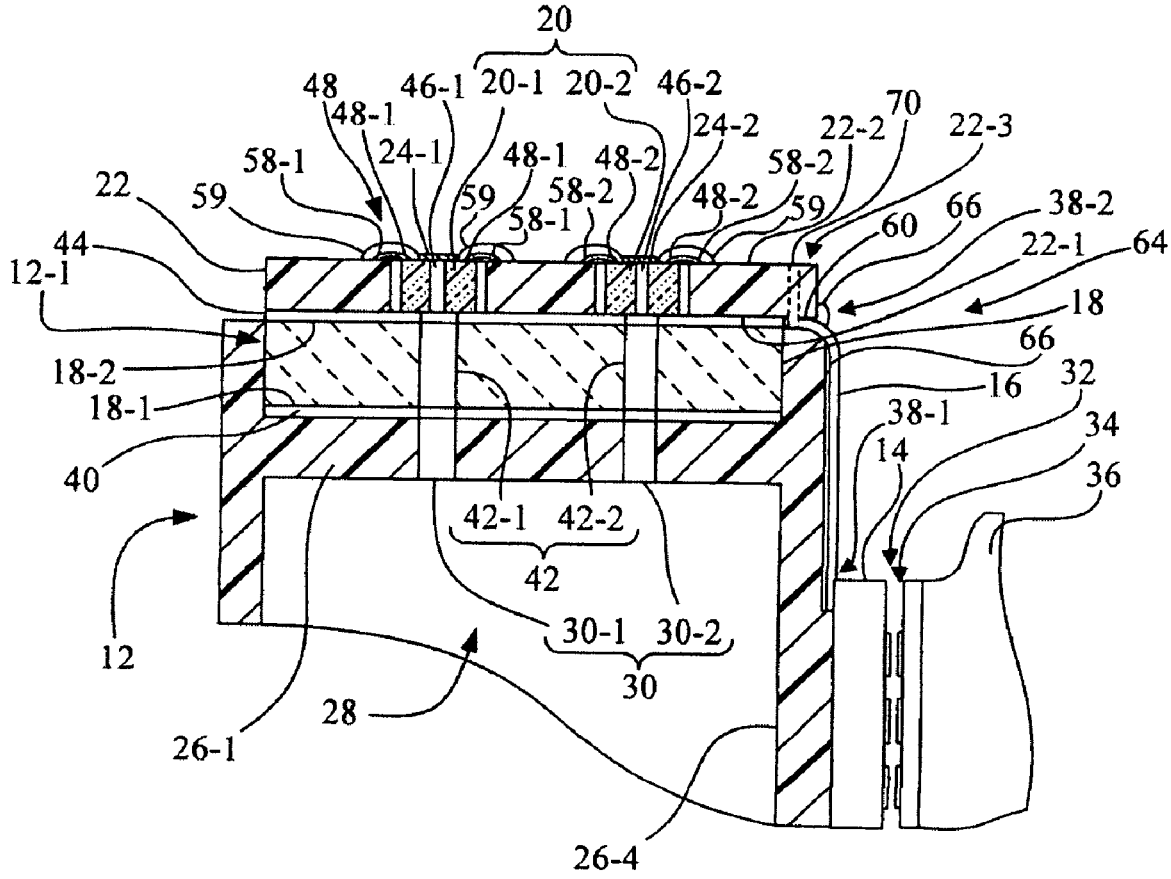
FIG. 3 is a section view of the ink jetting structure of FIG. 2 taken along line 3-3.

Referring now to the drawings and particularly to FIGS. 1-3, there is shown an ink jetting structure 10 configured in accordance with an embodiment of the present invention. Ink jetting structure 10 includes a base 12, a printer interface board 14, a flexible cable 16, a substrate 18, a plurality of ink jet heater chips 20, a printhead circuit member 22, and a plurality of nozzle plates 24, individually identified as nozzle plates 24-1, 24-2 and 24-3. In the present embodiment, ink jetting structure 10 may be a permanent printhead or a semi-permanent printhead for use in an ink jet printer. Also, ink jetting structure 10 may be integrated with an ink tank to form an ink jet printhead cartridge.

Base 12 has a floor 26-1 and a plurality of side walls 26-2, 26-3, 26-4, and 26-5 that extend outwardly from floor 26-1. Referring to FIG. 3, an ink receiving region 28 is defined by floor 26-1 and the plurality of side walls 26-2, 26-3, 26-4, and 26-5, wherein an ink source is provided. The ink source may be, for example, an ink tank, or a fluid interface coupled by conduits to a remote ink tank. Base 12 includes a recessed region 12-1 formed opposite to ink receiving region 28, i.e., with floor 26-1 interposed between recessed region 12-1 and ink receiving region 28. As shown in FIG. 3, floor 26-1 has a first plurality of fluid passages 30, individually identified as fluid passage 30-1 and fluid passage 30-2, for carrying ink received at ink receiving region 28.

In the present embodiment, a printer interface board 14 is mounted to base 12, and more particularly, to side wall 26-4 of base 12. Printer interface board 14 has a plurality of electrical contacts 32 positioned to engage corresponding contacts 34 on an ink jet printer 36 (see FIG. 3, with ink jet printer 36 only partially shown).

Flexible cable 16 has a plurality of conductors 38. The plurality of conductors 38 has a first end 38-1 and a second end 38-2. First end 38-1 is electrically connected to the plurality of electrical contacts 32 of printer interface board 14 to facilitate coupling of first end 38-1 of the plurality of conductors 38 of flexible cable 16 to corresponding contacts 34 on ink jet printer 36. Alternatively, first end 38-1 of the plurality of conductors 38 of flexible cable 16 may be directly electrically connected to corresponding contacts 34 of ink jet printer 36, without the use of printer interface board 14.

Substrate 18 is a planar structure, and is shaped to be received in recessed region 12-1 of base 12. Substrate 18 may be formed, for example, from a ceramic, a liquid crystal polymer (LCP), or other rigid substrate materials. Substrate 18 has a surface 18-1 and a surface 18-2 spaced from surface 18-1. Surface 18-1 of substrate 18 is attached to floor 26-1 of base 12, e.g., by an adhesive layer 40, such as with an epoxy, or alternatively by a gasket and fastener arrangement. Substrate 18 has a second plurality of fluid passages 42, individually identified as fluid passage 42-1 and fluid passage 42-2, extending from surface 18-1 to surface 18-2. The second plurality of fluid passages 42 of substrate 18 are in fluid communication, respectively, with the first plurality of fluid passages 30 of base 12.

In the present embodiment, referring to FIG. 3, the plurality of ink jet heater chips 20 are individually identified as ink jet heater chip 20-1, ink jet heater chip 20-2, and ink jet heater chip 20-3. The plurality of ink jet heater chips 20 may be mounted to surface 18-2 of substrate 18, e.g., by an adhesive layer 44, such as with an epoxy, before, during, or after attachment of printhead circuit member 22 to substrate 18. The plurality of ink jet heater chips 20 include electrical heater elements and associated ink ejection chambers (not shown) configured for ejecting ink when a respective heater element is electrically energized, as is known in the art. The plurality of ink jet heater chips 20 respectively includes a plurality of openings (e.g., openings 46-1 and 46-2 shown in FIG. 3) configured to respectively supply ink to the associated nozzle plates 24 (e.g., nozzle plates 24-1 and 24-2 shown in FIG. 3). The plurality of openings of the plurality of ink jet heater chips 20 are in fluid communication with the second plurality of fluid passages 42 of substrate 18. Each of the plurality of ink jet heater chips 20 includes a corresponding set of electrical contacts 48. In the embodiment shown in FIG. 3, ink jet heater chip 20-1 includes a set of electrical contacts 48-1 and ink jet heater chip 20-2 includes a set of electrical contacts 48-2.

Figure 4A:
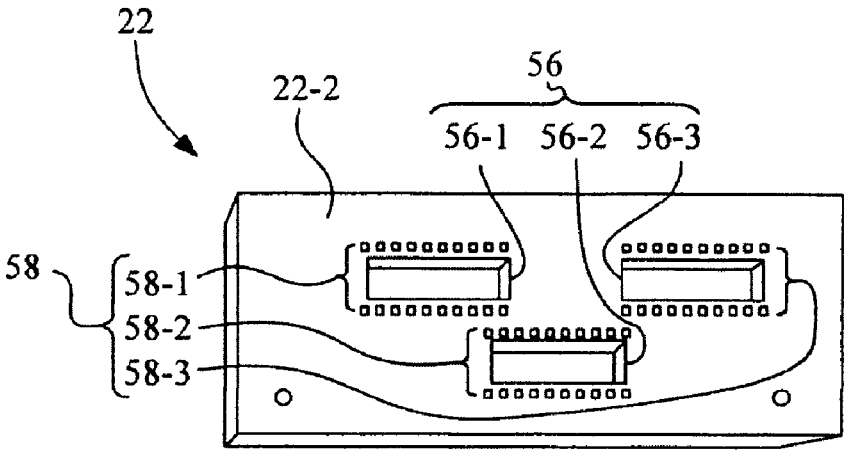
FIG. 4A is a view of the exposed surface of a printhead circuit member of the ink jetting structure of FIG. 1.
Figure 4B:
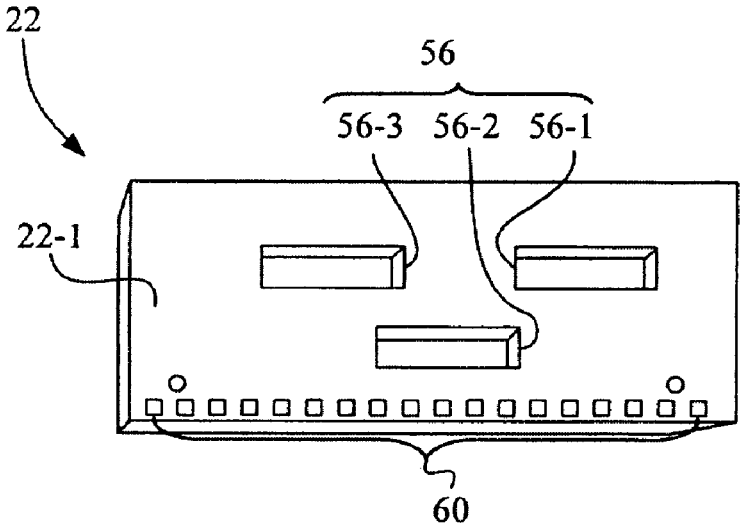
FIG. 4B is a view of the non-exposed surface of the printhead circuit member of FIG. 4A.
Figure 4C:
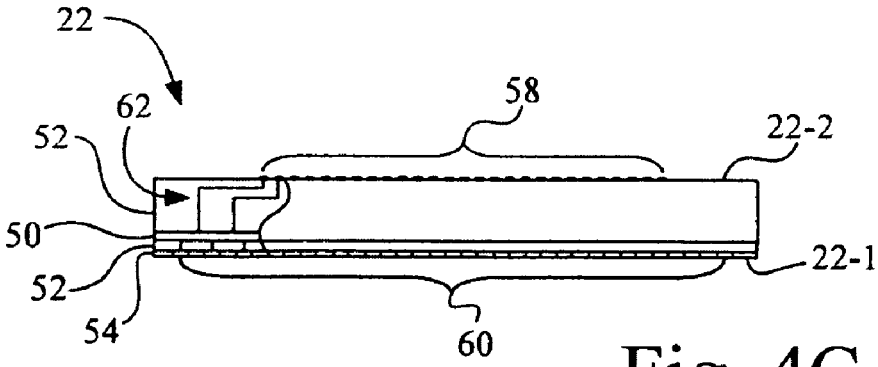
FIG. 4C is a side view of the printhead circuit member of FIGS. 4A and 4B, with a portion broken away to show embedded conductors.

Referring also to FIGS. 4A-4C, printhead circuit member 22 has a surface 22-1 and a surface 22-2 spaced from surface 22-1. Embedded conductors 50 are located, i.e., embedded, in printhead circuit member 22 between surface 22-1 and surface 22-2 as a trace layer, or multiple trace layers, also referenced herein as trace layer 50.

As shown in the embodiment of FIG. 4C, for example, printhead circuit member 22 may be a multilayer printed circuit board (PCB), with embedded conductors 50 (trace layer) being formed as an intermediate layer. More particularly, trace layer 50 is formed on a base layer 52 and is sealed over by a sealing layer 54. Alternatively, printhead circuit member 22 may be formed as a multilayer tape automated bond (TAB) circuit.

For example, one approach for fabricating printhead circuit member 22 is to cover the electrical traces on the PCB surface with some kind of conformal coating material (urethane, silicone, etc.), as sealing layer 54.

Another approach which may be more robust from a corrosion resistance standpoint is to move the traces to a wiring layer (e.g., trace layer 50) internal to the PCB with no exposed wiring traces on either surface of printhead circuit member 22, except where it is necessary to make connections to ink jet heater chips 20 and to flexible cable 16 that interfaces with ink jet printer 36. If some electrical vias or traces must be exposed on a surface of printhead circuit member 22 for manufacturing reasons, such electrical vias or traces may be kept on the bottom side (e.g., surface 22-1) of printhead circuit member 22 which will be attached to substrate 18 by adhesive 44 that can also serve to seal this side of printhead circuit member 22 against the corrosive effects of ink. Alternatively, a solder mask or conformal coating may be used for protection of the traces prior to attachment.

A third approach is to laminate an ink resistant film, as sealing layer 54, over any exposed wiring. These films may be thermoplastics or thermosetting films and may also have an adhesive layer, such as for example, polyimide films with B-staged epoxy, acrylic, or phenolic adhesives. This process would involve lamination through heat and pressure followed by baking for final cure characteristics.

Printhead circuit member 22 has a plurality of openings 56, individually identified as opening 56-1, opening 56-2 and opening 56-3, configured to receive the plurality of ink jet heater chips 20, respectively. Any gap between printhead circuit member 22 and ink jet heater chips 20 may be filled with a sealant, such as an epoxy. The set of electrical contacts 48 of the plurality of ink jet heater chips 20 are exposed through the plurality of openings 56 at surface 22-2 of printhead circuit member 22.

The surface 22-1 of printhead circuit member 22 is mounted to the surface 18-2 of substrate 18, e.g., by adhesive layer 44. The surface 22-2 of printhead circuit member 22 has an outer set of electrical contacts 58, individually identified in FIG. 4A as the set of electrical contacts 58-1, the set of electrical contacts 58-2, and the set of electrical contacts 58-3.

The outer set of electrical contacts 58 of printhead circuit member 22 is connected, e.g., attached by wire bonds, to the set of electrical contacts 48 of the plurality of ink jet heater chips 20. As shown in FIG. 3, for example, the set of electrical contacts 58-1 of printhead circuit member 22 are connected by wire bonding to the set of electrical contacts 48-1 of ink jet heater chip 20-1, and the set of electrical contacts 58-2 of printhead circuit member 22 are connected by wire bonding to the set of electrical contacts 48-2 of ink jet heater chip 20-2. An encapsulant 59 is located to hermetically seal around the set of electrical contacts 48 of plurality of ink jet heater chips 20 and the set of electrical contacts 58 of printhead circuit member 22.

As shown in FIG. 4C, the surface 22-1 of printhead circuit member 22 has a set of electrical contacts 60 electrically coupled by embedded conductors 50 and internal leads 62 in printhead circuit member 22 to the set of electrical contacts 58 of printhead circuit member 22. The set of electrical contacts 60 (see FIGS. 4B and 4C) is electrically connected to the second end 38-2 of the plurality of conductors 38 of said flexible cable 16 (see FIG. 3).

In the embodiment of FIG. 3, a portion 22-3 of the printhead circuit member 22 having the set of electrical contacts 60 cantilevers past substrate 18 and extends across a proximal end 64 of one of the plurality of side walls, e.g., side wall 26-4, of base 12. As shown in FIG. 3, the second end 38-2 of the plurality of conductors 38 of flexible cable 16 is interposed between the proximal end 64 of side wall 26-4 and the surface 22-1 of printhead circuit member 22. An encapsulant 66 is located to hermetically seal around the second end 38-2 of the plurality of conductors 38 of flexible cable 16 and the set of electrical contacts 60 of printhead circuit member 22.

Figure 5:
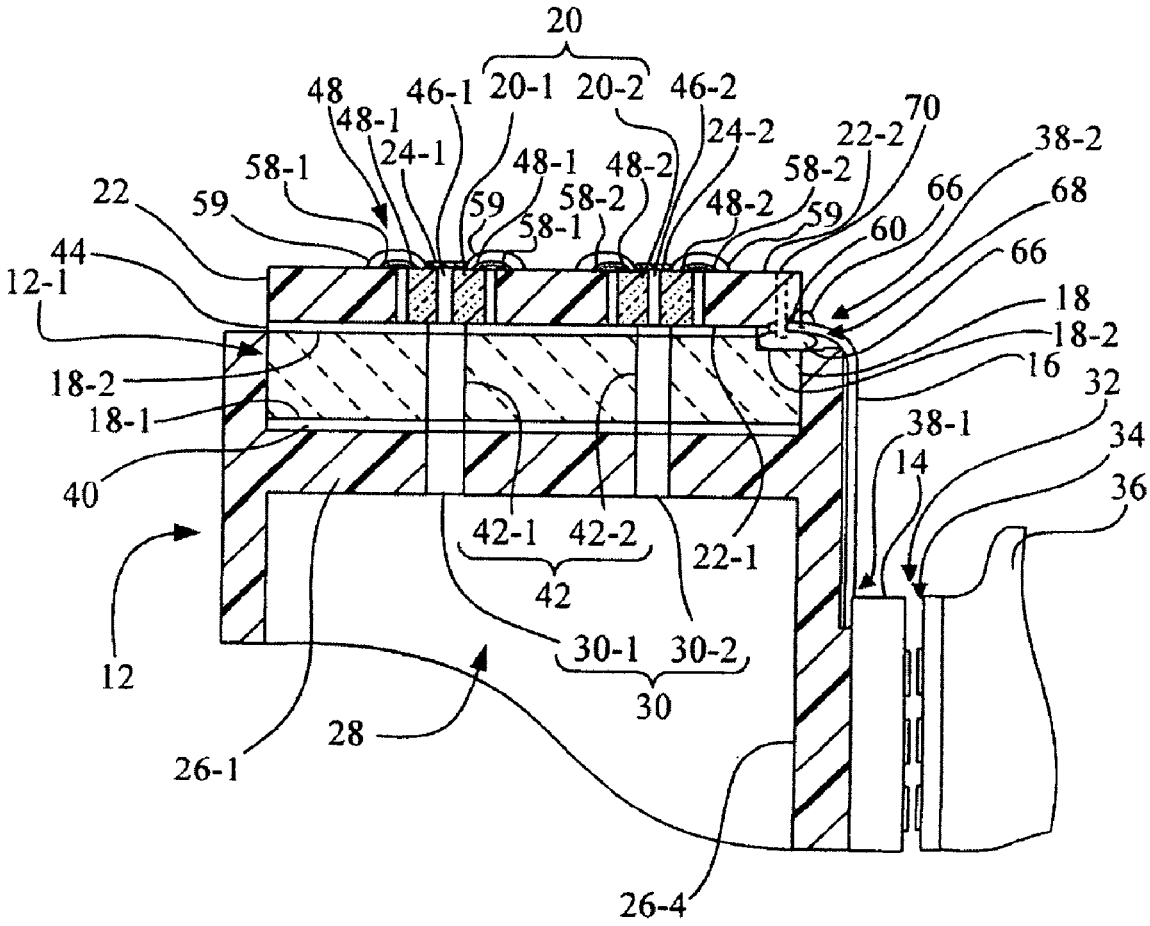
FIG. 5 is a section view of an ink jetting structure in accordance with another embodiment of the present invention, taken along a line corresponding to line 3-3 of FIG. 2.

The embodiment of FIG. 5 is similar to the embodiment of FIG. 3, except that printhead circuit member 22 having the set of electrical contacts 60 does not cantilever past substrate 18 and does not extend across side wall 26-4 of base 12. Rather, in the embodiment of FIG. 5, a void 68, e.g., a relief area, is located between substrate 18 and printhead circuit member 22 for accommodating the second end 38-2 of the plurality of conductors 38 of flexible cable 16 (connected to the set of electrical contacts 60 of surface 22-1 of printhead circuit member 22) between the surface 18-2 of substrate 18 and the surface 22-1 of printhead circuit member 22. Encapsulant 66 is located to hermetically seal around void 68.

Thus, in the embodiment of FIG. 5, the second end 38-2 of the plurality of conductors 38 of flexible cable 16 is interposed between the surface 18-2 of substrate 18 and surface 22-1 of printhead circuit member 22. Also, encapsulant 66 hermetically seals around second end 38-2 of the plurality of conductors 38 of flexible cable 16 and the set of electrical contacts 60 of printhead circuit member 22.

In at least one embodiment, printhead circuit member 22 and flexible cable 16 are assembled as a subassembly, with second end 38-2 of the plurality of conductors 38 of flexible cable 16 being connected to the set of electrical contacts 60 located at the surface 22-1 of printhead circuit member 22, prior to mounting to substrate 18. The subassembly including printhead circuit member 22 and flexible cable 16 may then be attached as a unit to substrate 18, i.e., with the surface 22-1 of printhead circuit member 22 being mounted to the surface 18-2 of substrate 18 by adhesive layer 44.

In another embodiment, printhead circuit member 22 and the plurality of ink jet heater chips 20 may be assembled as a subassembly, with second end 38-2 of the plurality of conductors 38 of flexible cable 16 being connected to the set of electrical contacts 60 located at the surface 22-1 of printhead circuit member 22, prior to mounting to substrate 18. The subassembly including printhead circuit member 22, the plurality of ink jet heater chips 20, and flexible cable 16 may then be attached as a unit to substrate 18, i.e., with the surface 22-1 of printhead circuit member 22 being mounted to the surface 18-2 of substrate 18 by adhesive layer 44.

In the embodiments of FIGS. 3 and 5, optional through holes 70 in printhead circuit member 22 may be used with corresponding through holes in the flexible cable 16 for automatic alignment using a fixture with through pins. Alternatively, alignment may be accomplished optically with no through holes. If through holes are used, after alignment the through holes may be filled with encapsulant to prevent ink access to the circuit and solder connections.

In the embodiments of FIGS. 3 and 5, the connection point of flexible cable 16 to printhead circuit member 22 at surface 22-1 advantageously is not at a surface (i.e., surface 22-2) that is exposed to ink or exposed to the mechanical force applied to printhead circuit member 22 by a printhead wiper during printhead maintenance, e.g., printhead wiping, thereby providing protection against corrosion, and permits more clear external surface area of the external surface 22-2 that may be used for a capping seal and for paper gap/clearance, i.e., the connections of flexible cable 16 to the set of electrical contacts 60 located at the surface 22-1 of printhead circuit member 22 are not exposed and do not protrude into the paper path of ink jet printer 36.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jetting structure, comprising:

a flexible cable having a plurality of conductors, said plurality of conductors having a first end and a second end, said first end being for coupling to corresponding contacts on a printer;

a substrate having a first surface and a second surface spaced from said first surface, said substrate having a second fluid passage extending from said first surface to said second surface, said second fluid passage being in fluid communication with said first fluid passage;

an ink jet heater chip mounted to said second surface of said substrate, said ink jet heater chip being in fluid communication with said second fluid passage of said substrate, and said ink jet heater chip including a first set of electrical contacts; and a printhead circuit member having a third surface and a fourth surface spaced from said third surface with embedded conductors being located between said third surface and said fourth surface, and having an opening configured to receive said ink jet heater chip with said first set of electrical contacts of said ink jet heater chip being exposed through said opening, said third surface being mounted to said second surface of said substrate, said fourth surface having a second set of electrical contacts attached by wire bonds to said first set of electrical contacts of said ink jet heater chip, and said third surface having a third set of electrical contacts electrically coupled by said embedded conductors in said printhead circuit member to said second set of electrical contacts, and said third set of electrical contacts being electrically connected to said second end of said plurality of conductors of said flexible cable.

2. The ink jetting structure of claim 1, further comprising a base having a floor and a plurality of side walls extending outwardly from said floor, said floor having a first fluid passage, said first surface of said substrate being mounted to said floor of said base, and wherein a portion of said printhead circuit member having said third set of electrical contacts extends across a proximal end of one of said plurality of side walls, said second end of said plurality of conductors of said flexible cable being interposed between said proximal end and said third surface of said printhead circuit member.

3. The ink jetting structure of claim 2, further comprising an encapsulant located to hermetically seal around said second end of said plurality of conductors and said third set of electrical contacts.

4. The ink jetting structure of claim 1, wherein said second end of said plurality of conductors of said flexible cable is interposed between said second surface of said substrate and said third surface of said printhead circuit member.

5. The ink jetting structure of claim 4, further comprising an encapsulant located to hermetically seal around said second end of said plurality of conductors of said flexible cable and said third set of electrical contacts.

6. The ink jetting structure of claim 1, wherein said substrate and said printhead circuit member define a void for accommodating said second end of said plurality of conductors of said flexible cable between said second surface of said substrate and said third surface of said printhead circuit member, and further comprising an encapsulant located to hermetically seal around said void.

7. The ink jetting structure of claim 1, further comprising an encapsulant located to hermetically seal around said first set of electrical contacts of said ink jet heater chip and said second set of electrical contacts of said printhead circuit member.

8. The ink jetting structure of claim 1, wherein said printhead circuit member and said flexible cable are assembled as a subassembly, and said subassembly is attached to said substrate, with said third surface of said printhead circuit member being mounted to said second surface of said substrate.

9. The ink jetting structure of claim 1, wherein said printhead circuit member, said ink jet heater chip, and said flexible cable are assembled as a subassembly, and said subassembly is attached to said substrate, with said third surface of said printhead circuit member being mounted to said second surface of said substrate.

10. The ink jetting structure of claim 1, wherein said printhead circuit member is a printed circuit board.

11. The ink jetting structure of claim 1, wherein said printhead circuit member is formed as a multilayer tape automated bond (TAB) circuit.

12. The ink jetting structure of claim 1, further comprising a base having a floor and a plurality of side walls extending outwardly from said floor, said floor having a first fluid passage, and said first surface of said substrate being mounted to said floor of said base.

13. An ink jetting structure, comprising:

a base having a floor and a plurality of side walls extending outwardly from said floor, said floor having a first fluid passage;

a flexible cable having a plurality of conductors, said plurality of conductors having a first end and a second end, said first end being for coupling to corresponding contacts on a printer;

a ceramic substrate having a first surface and a second surface spaced from said first surface, said first surface being mounted to said floor of said base, said ceramic substrate having a second plurality of fluid passages extending from said first surface to said second surface, said second plurality of fluid passages being in fluid communication with said first plurality of fluid passages;

a plurality of ink jet heater chips mounted to said second surface of said ceramic substrate, said plurality of ink jet heater chips being in fluid communication with said second plurality of fluid passages of said ceramic substrate, and each of said plurality of ink jet heater chips including a corresponding first set of electrical contacts; and a printhead circuit member having a third surface and a fourth surface spaced from said third surface with embedded conductors being located between said third surface and said fourth surface, and having a plurality of openings configured to receive said plurality of ink jet heater chips with said first set of electrical contacts of said plurality of ink jet heater chips being exposed through said plurality of openings, said third surface being mounted to said second surface of said ceramic substrate, said fourth surface having a second set of electrical contacts attached by wire bonds to said first set of electrical contacts of said plurality of ink jet heater chips, and said third surface having a third set of electrical contacts electrically coupled by said embedded conductors in said printhead circuit member to said second set of electrical contacts, and said third set of electrical contacts being electrically connected to said second end of said plurality of conductors of said flexible cable 14. The ink jetting structure of claim 13, wherein a portion of said printhead circuit member having said third set of electrical contacts extends across a proximal end of one of said plurality of side walls, said second end of said plurality of conductors of said flexible cable being interposed between said proximal end and said third surface of said printhead circuit member.

15. The ink jetting structure of claim 14, further comprising an encapsulant located to hermetically seal around said second end of said plurality of conductors and said third set of electrical contacts.

16. The ink jetting structure of claim 13, wherein said second end of said plurality of conductors of said flexible cable is interposed between said second surface of said ceramic substrate and said third surface of said printhead circuit member.

17. The ink jetting structure of claim 16, further comprising an encapsulant located to hermetically seal around said second end of said plurality of conductors of said flexible cable and said third set of electrical contacts.

18. The ink jetting structure of claim 13, wherein said ceramic substrate and said printhead circuit member define a void for accommodating said second end of said plurality of conductors of said flexible cable between said second surface of said ceramic substrate and said third surface of said printhead circuit member, and further comprising an encapsulant located to hermetically seal around said void.

19. The ink jetting structure of claim 13, further comprising an encapsulant located to hermetically seal around said first set of electrical contacts of said plurality of ink jet heater chips and said second set of electrical contacts of said printhead circuit member.

20. The ink jetting structure of claim 13, wherein said printhead circuit member and said flexible cable are assembled as a subassembly, and said subassembly is attached to said ceramic substrate, with said third surface of said printhead circuit member being mounted to said second surface of said ceramic substrate.

* * * * *